United States Patent [19]

Ing

[11] Patent Number: 4,799,718

[45] Date of Patent: Jan. 24, 1989

[54] SABOTAGE-PROOF LOCK DEVICE WITH ELBOW-SHAPED LATCHES

[76] Inventor: Kuo S. Ing, 7 Fl., No. 88, Jong-Yi Street, Shilin Dist., Tapiei, Taiwan

[21] Appl. No.: 896,075

[22] Filed: Aug. 13, 1986

[51] Int. Cl.[4] ..... E05C 5/02

[52] U.S. Cl. ..... 292/36

[58] Field of Search ..... 292/36, 8, 26, 97, 191, 292/192, 302, DIG. 46, 113, 139

[56] References Cited

U.S. PATENT DOCUMENTS

| | | | |
|---|---|---|---|
| 609,197 | 8/1898 | Fries | 292/36 |
| 914,424 | 3/1909 | Kelly | 292/36 |
| 1,264,814 | 4/1918 | Kornstein | 292/36 X |
| 1,496,172 | 6/1924 | Rogers | 292/58 X |
| 1,915,395 | 6/1933 | Welling | 292/189 X |
| 2,047,464 | 7/1936 | Flacksborth | 292/114 |
| 4,635,980 | 1/1987 | DeLuca | 292/109 X |

*Primary Examiner*—Richard E. Moore

*Attorney, Agent, or Firm*—Asian Pacific Int'L Patent and Trademark Office

[57] ABSTRACT

L-shaped latches are guided by elbow-shaped recess formations in a base to prevent sabotage by a door picker or burglar. Through a transmission mechanism, the L-shaped latches are inserted into respective latch sockets furnished on the door jamb.

1 Claim, 2 Drawing Sheets

SABOTAGE-PROOF LOCK DEVICE WITH ELBOW-SHAPED LATCHES

BACKGROUND OF THE INVENTION

According to a conventional door lock, the engagement of the lock latch in the latch channel at the jamb is a straight locking and unlocking, i.e., the flat-plate latch is horizontally driven into a " [ "-shaped latch channel to maintain the door in locking condition. For unlocking the door, the latch will be pulled out of the latch channel in the reverse and straight motion.

The aforesaid method can be rather easily sabotaged by a door picker. The latch of the conventional lock with one locking step has only a short portion extending into a latch channel, and the lock of that type can be unlocked easily by a door picker by hitting the door with such a force so as to move the door body and the deform latch, and then the latch will be pulled out of the latch channel, as can be seen very often in the movies.

Further, in the conventional two-step or three-step locks, the latch can be deeper introduced into the latch channel than that of the one-step type of lock, but the depth of the latch channel is still limited by the thickness of the door jamb. To sabotage a two or three-step type of lock, the door picker usually inserts a crowbar between the door body and the jamb to cause a gap (in order to facilitate the door to open and close, a gap is usually maintained between the door body and the jamb) and so as to retract the latch a given length; then, the door picker or burglar pushes or hits the door with force to have the latch retracted out of the latch channel, and the door will be opened in unauthorized manner.

Briefly, in the conventional locks, no matter whether an electronic lock or mechanical lock, usually a straight type of latch engage in linear motion or straightly into the latch channel; and, therefore, it is very easy for the door picker to pry the door open with a crowbar.

In view of the aforesaid disadvantages of the conventional door locks, the inventor has, through repeated studies and improvements, developed a substantially sabotage-proof lock comprising an elbow-shaped latch. The latch of the lock is substantially secured against being pried out, and it can substantially prevent a door with my type of lock from being forcefully and unauthorized opened by a door picker or burglar.

The lock device according to the present invention includes a transmission mechanism, which can drive respective upper and lower latches to slide along an elbow-shaped groove. The latches are first driven to slide horizontally to enter into the latch channel in the jamb, and then driven to slide vertically until entering into the latch sockets respectively. After the L-shaped latches are engaged with the walls of the latch sockets, it will be very difficult to pry the latches out with a crowbar.

SUMMARY OF THE INVENTION

This invention relates to a lock device, of which the transmission mechanism can drive upper and lower latches to slide along an elbow groove; the latches are driven to slide horizontally to enter into the latch channel on the jamb, and then to slide vertically to enter into the latch sockets respectively. This special design can prevent the lock from being pried with a crowbar or the like, and prevent a door from being banged with force to push the lock open.

The other objects and advantages of the present invention are described further in the detailed description with reference to the accompanying drawings, which show the embodiment of the present invention.

DETAILED DESCRIPTION

Figure 1:
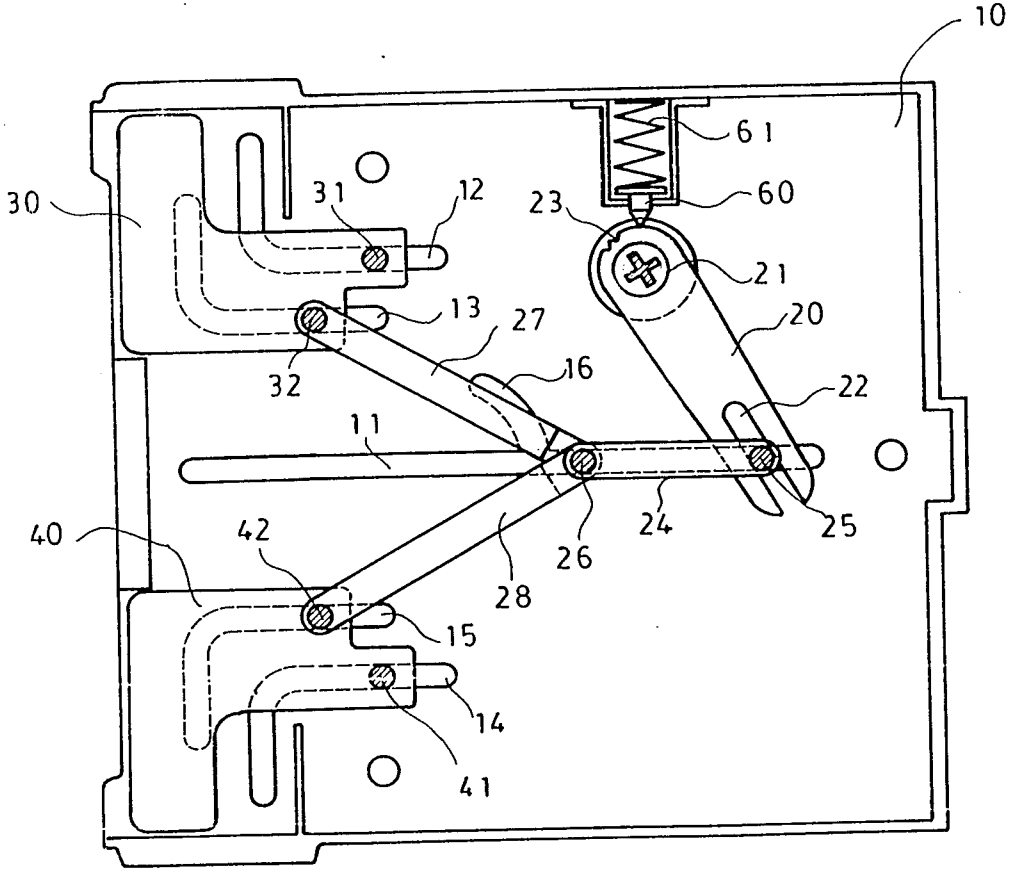
FIG. 1 is a plan view of an embodiment of the present invention, which shows the latches are not extended out of the case thereof.

Referring to FIG. 1, it shows a pivotal transmission mechanism or elbow-shaped mounted on a fastening board 10, and upper and lower L-shaped latches 30 and 40 mounted oppositely and symmetrically on the fastening board 10. The pivotal transmission mechanism comprises a swinging arm 20, two linking arms 27 and 28 connected pivotally to the latches 30 and 40 respectively, and a linking rod 24 connected to the swinging arm 20 and the two linking arms 27 and 28.

The fastening board 10 is provided with a straight groove 11 and two pairs of opposite and symmetrical elbow grooves 12 and 13, 14 and 15, i.e. elbow-shaped recess formations. Both ends of the linking rod 24 are provided with two pivots 25 and 26 respectively, which extend into the straight groove 11 in a slidable manner so as to let the linking rod 24 slide back and forth along the straight groove 11. The inner side of each of the two L-shaped latches 30 and 40 is furnished with a pair of pivots or pivot members 31 and 32, 41 and 42 respectively. The pivots 31 and 32, 41 and 42 are mounted into the elbow grooves 12 and 13, 14 and 15 respectively so as to have the two latches 30 and 40 slide back and forth only along the elbow grooves 12 and 13, 14 and 15; in other words, the upper L-shaped latch 30 can slide horizontally outwards and then vertically upwards, while the lower L-shaped latch 40 can slide horizontally outwards and then vertically downwards.

The swinging arm 20 in the pivotal transmission mechanism is substantially a driving member to actuate the linking rod 24 and the two linking arms 27 and 28. The top end of the swinging arm 20 is mounted on a shaft 21 that is connected together with a conventional lock cylinder (not shown). Upon the shaft 21 being turned manually, the swinging arm 20 can be swung leftward or rightward. The lower end of the swinging arm 20 is provided with a slot 22 with one open end. The pivot 25 on the inner side of one end of the linking rod 24 is mounted in the slot 22. Upon operating the shaft 21 to swing the swinging arm 20, the upper and lower latches 30 and 40 will be actuated through the linking rod 24 and the two linking arms 27 and 28 to slide along the elbow grooves 12 and 13, 14 and 15 respectively.

Figure 2:
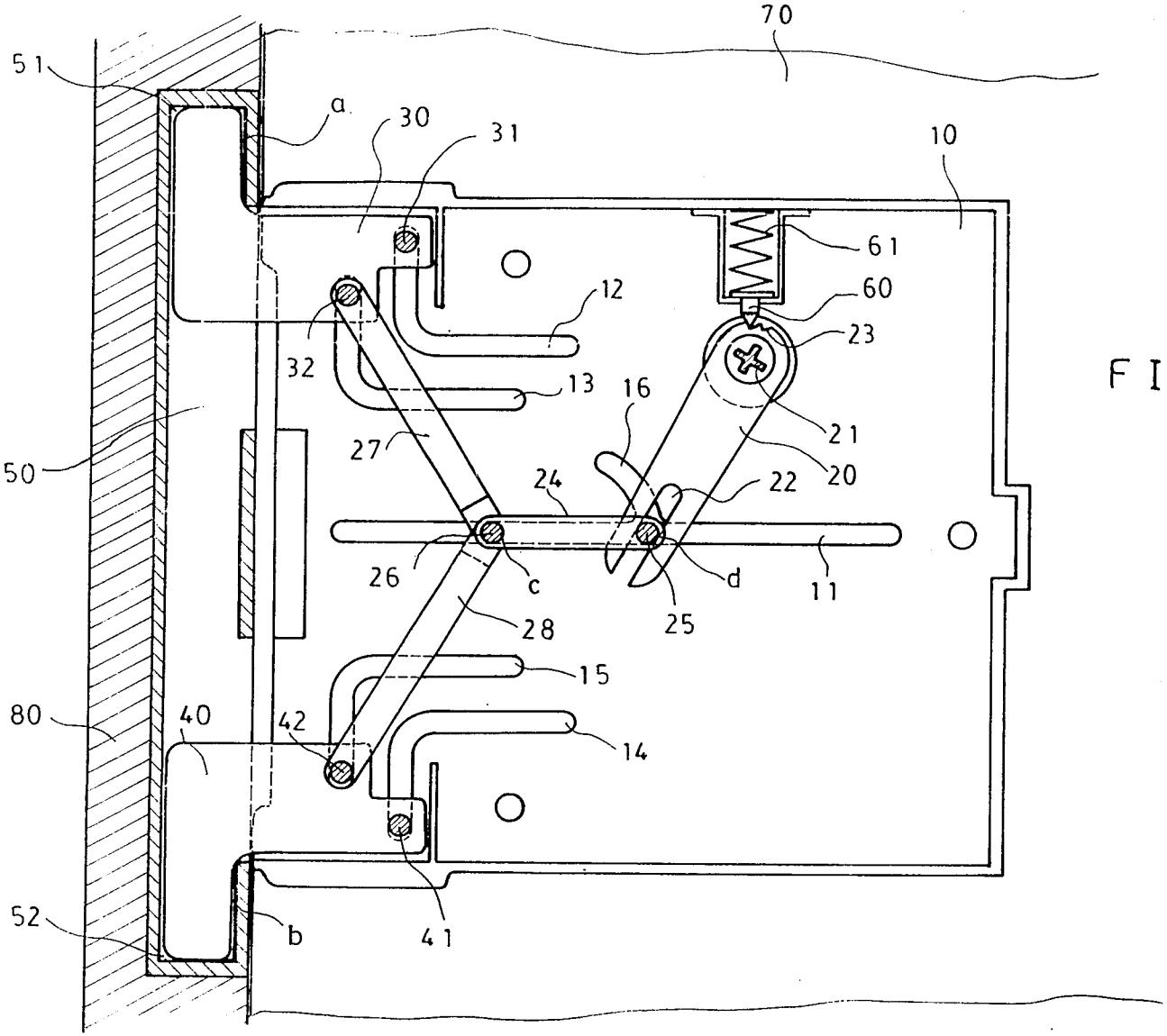
FIG. 2 is another plan view of the present invention, which shows the latches are fitted into the latch channels and then into the latch sockets.

Referring to FIG. 2, it shows the two latches 30 and 40 are moved horizontally first and then vertically to enter into the upper and the lower latch channels 50 respectively, and then to enter into the upper and lower latch sockets 51 and 52 respectively.

Upon a door being locked up that way, the door picker or burglar will not be able to pry the door or make it open by using a crowbar inserted between the door jamb 80 and the door body 70 because of the elbow ends of the two latches 30 and 40 being tightly engaged with the inner surfaces of the latch sockets 51 and 52 respectively as shown respectively at "a" and "b" of FIG. 2, and also because of the pivots 31 and 32, 41 and 42 being caught by the wall surfaces of the elbow grooves 12 and 13, 14 and 15. Moreover, since the latches 30 and 40 are inserted into the latch channel 50 with a considerable depth which cannot be changed or reduced by a prying means, the door can withstand a door picker's forceful striking.

In FIG. 2, the door is furnished with two latches 30 and 40, the upper and lower latches, which can prevent the door from being pried upward or downwards by a door picker. Of course, one L-shaped latch 30 may be used in one embodiment of the present invention.

In order to prevent the door from being pried with a crowbar or other tool inserted into the gap between the door body 70 and the jamb 80 to press down the upper L-shaped latch 30 or to lift up the lower L-shaped latch 40 so as to have the latches 30 and 40 slide out of the latch channel 50, a curve-shaped groove 16 is furnished above the pivot 25 as shown in FIG. 2. Thus, when a door picker presses down the upper latch 30 or lifts up the latch 40, that operational force will cause the linking rod 24 to generate a rightward component of force (the component of force will be much less than the original operational force via the pivotal transmission mechanism) through the resistance of the linking arms 27 and 28, and the wall of the straight groove 11 (point c in FIG. 2); further, since the right end pivot 25 of the linking rod 24 is stopped by the wall (point d in FIG. 2) of the slot 22 of the swinging arm 20, the pivot 25 can only slide, along the slot 22, into the curve-shaped groove 16 because the swinging arm 20 does not move. The curve-shaped groove 16 is substantially a part of a circle, having its center at pivot 26 and the radius is the distance between the pivot 25 and 26; therefore, upon the pivot 25 sliding into the curve-shaped groove 16, the pivot 26 will not move. In other words, no matter whether the lower latch 40 is pried upwards or the upper latch 30 is pried downwards, the latches 30 and 40 will not move.

The top end of the swinging arm 20 is furnished with several teeth 23, which are engaged with a pin 60 loaded with a spring 61. Upon the swinging arm 20 being turned, the operating person would feel, according to the click, whether the latches 30 and 40 have entered into the latch channel 50 or the latch sockets 51 and 52.

Briefly, the present invention does have the feature of preventing a door picker from prying the latches 30 and 40, or from banging the door to open with force because of utilizing the pivotal transmission mechanism to have the L-shaped latches 30 and 40 entered into the latch sockets 51 and 52 respectively, and therefore the present invention is much more improved than the conventional door locks in terms of resisting sabotage by a door picker.

It is expected that the aforesaid embodiment may be changed, amended or added to without deviating from the spirit and scope of the present invention; therefore, the present invention is deemed to be defined only by the claims attached.

I claim:

1. A lock device comprising:

a fastening board having at least one elbow-shaped recess formation for guiding a respective latch;

for each elbow-shaped recess formation, one L-shaped latch, said L-shaped latch having an inner side;

at least one pivot member positioned at the inner side of said L-shaped latch and in a respective elbow-shaped recess formation;

a transmission mechanism operatively connectable at said fastening board and accessible from the exterior of said fastening board to actuate said L-shaped latch to slide along its respective elbow-shaped recess formation; said transmission mechanism including:

a swing arm having a top end and a lower end, said lower end including a slot formation having a open end;

a shaft connected to said top end of said swing arm such that said top end is perpendicularly coupled to said shaft;

at least one linking arm pivotally connected to said L-shaped latch; and a linking rod, of which one end is pivotally connected to said linking arm, and the other end is pivotally engaged in said slot formation at the lower end of said swing arm.

* * * * *